US012092410B2

(12) United States Patent
Richter et al.

(10) Patent No.: US 12,092,410 B2
(45) Date of Patent: Sep. 17, 2024

(54) SAFETY SELECTOR LEVER FOR A MANUAL FIREARM SAFETY

(71) Applicant: mb-microtec ag, Niederwangen bei Bern (CH)

(72) Inventors: Karsten Richter, Bern (CH); Philipp Michel, Gümligen (CH); Christian Schoen, Paderborn (DE)

(73) Assignee: mb-microtec ag, Niederwangen bei Bern (CH)

( * ) Notice: Subject to any disclaimer, the term of this patent is extended or adjusted under 35 U.S.C. 154(b) by 0 days.

(21) Appl. No.: 18/153,012

(22) Filed: Jan. 11, 2023

(65) Prior Publication Data

US 2024/0230262 A1 Jul. 11, 2024

(51) Int. Cl.
*F41A 17/52* (2006.01)

(52) U.S. Cl.
CPC ..... *F41A 17/52* (2013.01)

(58) Field of Classification Search
CPC ..... F41A 17/42; F41A 17/46; F41A 17/52; F41A 17/62; F41A 17/70; F41A 17/80
USPC ..... 42/70.04, 70.05, 70.06, 70.08; 89/142, 89/148
See application file for complete search history.

(56) References Cited

U.S. PATENT DOCUMENTS

| | | | | | |
|---|---|---|---|---|---|
| 2,451,003 | A * | 10/1948 | Syrjala | F41A 17/56 | 42/70.04 |
| 2,887,086 | A * | 5/1959 | Boldt | F24C 7/082 | 126/214 B |
| 5,016,378 | A * | 5/1991 | Sain | F41A 17/52 | 42/1.01 |
| 6,510,641 | B1 * | 1/2003 | Viani | F41A 17/02 | 42/70.11 |
| 8,276,502 | B1 * | 10/2012 | Wright | F41A 35/06 | 42/70.08 |
| 8,650,790 | B2 * | 2/2014 | Dionne | F41A 17/00 | 42/70.11 |
| 10,466,002 | B1 | 11/2019 | Geissele | | |
| 11,015,887 | B1 | 5/2021 | Huang | | |
| 11,709,028 | B1 * | 7/2023 | Vernon | F41A 17/42 | 42/70.01 |
| 2020/0240731 | A1 * | 7/2020 | Karchon | F41A 19/33 | |

* cited by examiner

*Primary Examiner* — Bret Hayes

(57) ABSTRACT

A safety selector assembly for retrofitting a manual firearm safety of a firearm and a safety selector lever for the manual firearm safety. So that the safety and/or fire mode of the firearm can be clearly read, the invention proposes for the opacity of the head section to be interrupted by at least one see-through region between the front side and back side positioned eccentrically to the rotation axis in order to thus enable visibility of at least one safety marking of the manual firearm safety.

23 Claims, 4 Drawing Sheets

SAFETY SELECTOR LEVER FOR A MANUAL FIREARM SAFETY

FIELD OF THE INVENTION

The invention relates to a safety selector lever for a manual firearm safety of a firearm, having a head section with a front side and a back side, wherein the head section has either a connecting region formed onto the back side for connecting to a lever shaft or a protruding lever shaft formed onto the back side, and having an elongated lever section that adjoins the head section and is embodied for manual actuation of the safety selector lever in order to thus rotate the head section around a rotation axis of the lever shaft.

DESCRIPTION OF THE PRIOR ART

A safety selector lever for a manual firearm safety is known from U.S. Ser. No. 10/466,002B1 or U.S. Ser. No. 11/015,887B1. This safety selector lever has a round head section and an elongated lever section, which adjoins the head section and is embodied for manual actuation of the lever in order to thus rotate the head section around a rotational axis of the lever shaft. This lever shaft, which is inserted into a groove-shaped connection region on the back side of the head section, is secured by a screw extending from the front side of the head section.

The circular head section forms a point on the circular outer contour, which, pointing in the imaginary extension of the lever section, is supposed to facilitate the alignment with a safety marking. A contribution to this is supposed to be made by a gaseous tritium light source (GTLS) mounted in the lever section, which through continuous illumination, indicates the position of the safety selector lever even in poor visibility conditions.

The comparatively complexly designed features in the lever section do in fact enhance the optical visibility, but cannot contribute to reliable recognition of the associated safety marking in this lever position—for example indicating whether the firearm is in a safety mode or in a ready-to-fire mode.

The object of the invention, therefore, is to modify a safety selector lever for a firearm safety in such a way that it permits the respective mode of a firearm to be clearly read.

SUMMARY OF THE INVENTION

Because the opacity of the head section is interrupted by at least one see-through region between the front side and back side, which is positioned eccentrically to the rotation axis, unlike with known safety selector levers, visibility of at least one safety marking of the manual firearm safety can be enabled even if the safety selector lever is positioned over this safety marking. Depending on the rotation position of the safety selector lever, a user's attention can be optically drawn to a safety marking that corresponds to the rotation position—this safety marking is also clearly discernible because of the see-through region. The respective mode of the firearm can thus be clearly read. Corresponding to the safety marking that is optically discernible because of the see-through region, the mode of the firearm is thus also clear to the user. This mode can, for example, be a "safety mode" that is produced, for example, by a blocking of the trigger path of the forearm or a "ready-to-fire or safety-off mode" for example for semi-automatic firing, automatic firing, and the like.

Suitably, the opacity of the head section may be 100% and therefore non-translucent—in other words, opaque. This opacity can be produced through light absorption, light reflection, or light scattering. Suitably, the opacity of the head section may be achieved by an opaque material of the head section. Suitably, the see-through region has a boundary defined by the opaque region of the head section, and may be in the form of a transparent window or an opening in the head section.

The design of the safety selector lever can be further simplified if the see-through region is formed by an opening in the opaque material of the head section, which opening penetrates the head section from the front side to the back side.

Suitably, the see-through region has a transparent material within the opaque material of the head section, which transparent material penetrates the head section from the front side to the back side. The transparent material, functioning as a kind of window, can make it possible to see through the opaque material.

Alternatively to the above-described recess, it is conceivable that the see-through region is constituted by a transparent material within the opaque material of the head section. The safety selector lever with this transparent material and opaque material can be produced, for example, by means of a 2-component injection molding process.

The intuitive understanding of the connection between the mode of the firearm and the rotation position of the safety selector lever can be further improved if the see-through region in the head section extends in a radial direction.

Alternatively or in addition to this, the see-through region in the head section can extend in a straight line in order to further improve the foregoing.

The actuation of the safety selector lever can also be further facilitated if the lever section extends in a straight line that protrudes from the head section in a radial direction.

The foregoing can be further improved if the radial paths of the see-through region and the lever section are positioned so that the radial paths are aligned with each other.

Suitably, the head section may be embodied as circular in its outer dimensions in order to further simplify the design.

If the lever section extends partway across the head section, then the actuating surface on the lever section can be embodied as large enough despite the reduced dimensions of the safety selector lever.

Suitably, the connecting region or the lever shaft protruding therefrom may be provided centrally on the head section in order to further facilitate operation of the safety selector lever.

If the connecting region is embodied as a protruding tongue on the back side of the head section, then it is possible to produce a rotationally coupled connection between the safety selector lever and the lever shaft.

The safety selector lever according to the invention is particularly suitable for a safety selector assembly for retrofitting a manual firearm safety of a firearm. This safety selector assembly can also have a support, wherein the head section of the safety selector lever is rotatable relative to the support about the rotation axis, and a first safety marking is visible through the see-through region of the head section in a first rotational position of the head section and not visible through the see-through region of the head section in a second rotational position of the head section. It is thus possible, for example, to improve the optical perception of the manual firearm safety on a firearm without having to perform a modification of other components of the firearm. The invention is thus also comparatively easy to use in a retrofitting procedure.

The safety selector assembly may also include a second safety marking that is visible through the see-through region of the head section in the second rotational position of the head section and not visible through the see-through region of the head section in the first rotational position of the head section. Thus it is possible, for example, to improve the optical perception of the different modes of the manual firearm safety. This is especially the case when the second safety marking is visually different than the first safety marking.

Suitably, the safety marking includes a light source. The light source may be an electroluminescent light source, a phosphorescent light source, a fluorescent light source, a radioluminescent light source, a bioluminescent light source, or combinations of any of these light sources, in order to make the safety marking clearly perceptible from an optical standpoint even in poor visibility conditions. A light source may have various forms. The electroluminescent light source may be an LED. The other light sources may be in the form of a gel, gum, emulsion, putty, liquid paint, varnish, curable resin, wax, tape, glow tube, glow stick, paste, or the like, applied to the support.

This provides a clearly perceptible safety marking that can also be reliably perceived through the see-through region. This significantly improves the safety and thus also handling of the firearm.

For example, a gaseous tritium light source (GTLS) may be provided in at least one recess of the support. This significantly improves the mechanical protection of the gaseous tritium light source (GTLS). The recess may be on a first outer surface of the support.

This is particularly the case because the gaseous tritium light source is hermetically sealed in the recess by a protective layer.

It is conceivable for the support to be embodied as annular and thus for it to be disk-shaped. It is also conceivable for the support, on a second outer surface that is situated opposite from a first outer surface with the safety marking, to have an adhesive in order to also be able to mount this support on the firearm secured against rotation as well.

Alternatively to this, it is conceivable for the support to have at least one leg and a connector piece that connects to the at least one leg, wherein the at least one leg has the safety marking. This makes it much easier to mount on the firearm. Thus, for example, the support can be provided and fastened between the grip handle and housing of the firearm. A firearm can therefore be easily retrofitted with the safety selector assembly according to the invention in order to enhance safety.

This support may be also embodied as U-shaped with two legs and with the connector piece that connects the legs, for example, to view the mode of the firearm from two sides.

The design of the firearm can be simplified even more if at the same height, the two legs each have a through-hole for guiding the lever shaft through.

In another design embodiment of the support, it is conceivable for at least one extension section of a grip handle of the firearm to form the support. For example, this does not increase the number of parts of the firearm, which also does not change the handling of the firearm, for example when cleaning it. Also, this at least one extension section can additionally have the safety marking.

The design can be further simplified if the grip handle has two identical extension sections, each with a safety marking. The mode of the firearm is therefore visible from both sides.

It is also conceivable for the at least one extension section to have a through-hole for guiding the lever shaft through in order to thus facilitate, for example, the mounting of the manual firearm safety.

Suitably, the extension section has a recess in which the safety selector lever is rotatably supported. The lever can thus be protected from damage, for example, and the ruggedness of the manual firearm safety can be further improved.

The safety selector lever according to the invention as well as the safety selector assembly according to the invention are particularly suitable for a firearm with a manual firearm safety. For example, the firearm can be an AR-15-style rifle.

BRIEF DESCRIPTION OF THE DRAWINGS

In the figures, the subject of the invention is shown by way of example based on multiple embodiment variants. In the drawings.

DETAILED DESCRIPTION OF THE INVENTION

Figure 1:
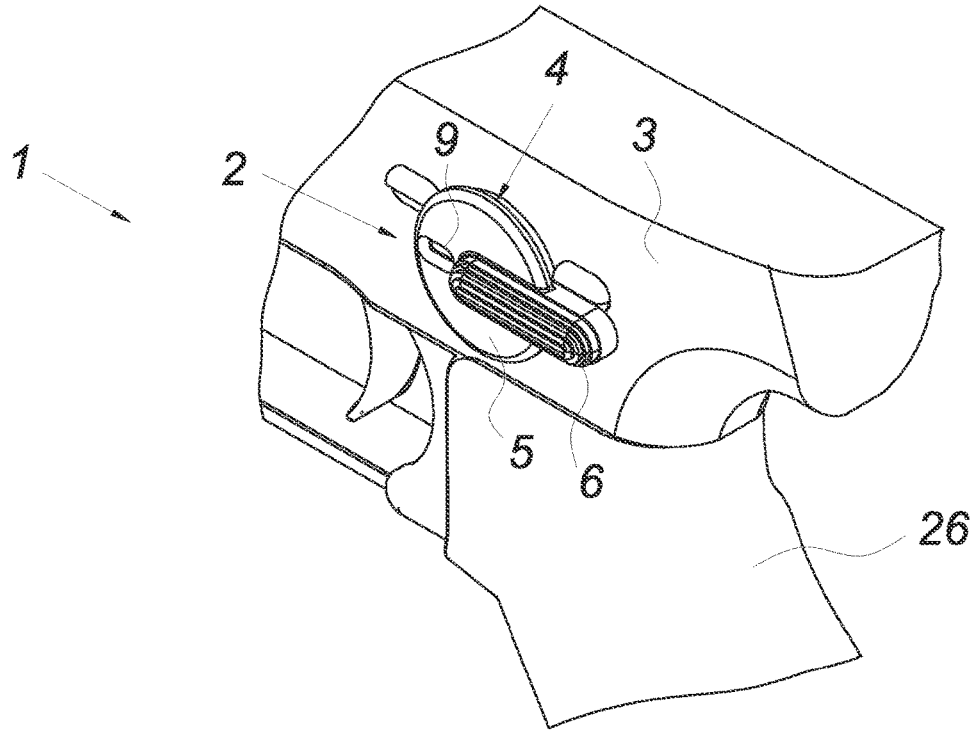
FIG. 1 shows a view of a partially depicted firearm with a first embodiment of the safety selector assembly for retrofitting a manual firearm safety of a firearm.

FIG. 1 shows a firearm 1, namely a part of an AR-15-style rifle, which has a manual firearm safety 2 on the housing 3 of the firearm 1. By means of a blocking element, which is provided on the firearm 1 and is not shown in the figures, the manual firearm safety 2 prevents firing by mechanically blocking the function of the firearm 1—for example blocking the trigger path. This blocking can involve different parts in the trigger path, for example the trigger tongue, the hammer device, and the like.

A firearm can, for example, be a gun, a small arm, a handgun, a pneumatic weapon, a pistol, a long gun, a self-loading long gun, a rocket launcher, and the like.

The manual firearm safety 2 is manually actuated by means of a safety selector lever 4, 104. In all of the exemplary embodiments, the firearm 1 is provided with two safety selector levers 4, 104, one on each side of the firearm 1. As a result, the firearm 1 according to the first and second exemplary embodiments shown in FIGS. 1 to 4 has a first safety selector lever 4 and a second safety selector lever 104. The firearm according to the third exemplary embodiment shown in FIGS. 5 and 6 has two second safety selector levers 104. The manual firearm safety 2 can thus be manually actuated from either side of the firearm 1.

Figure 2:
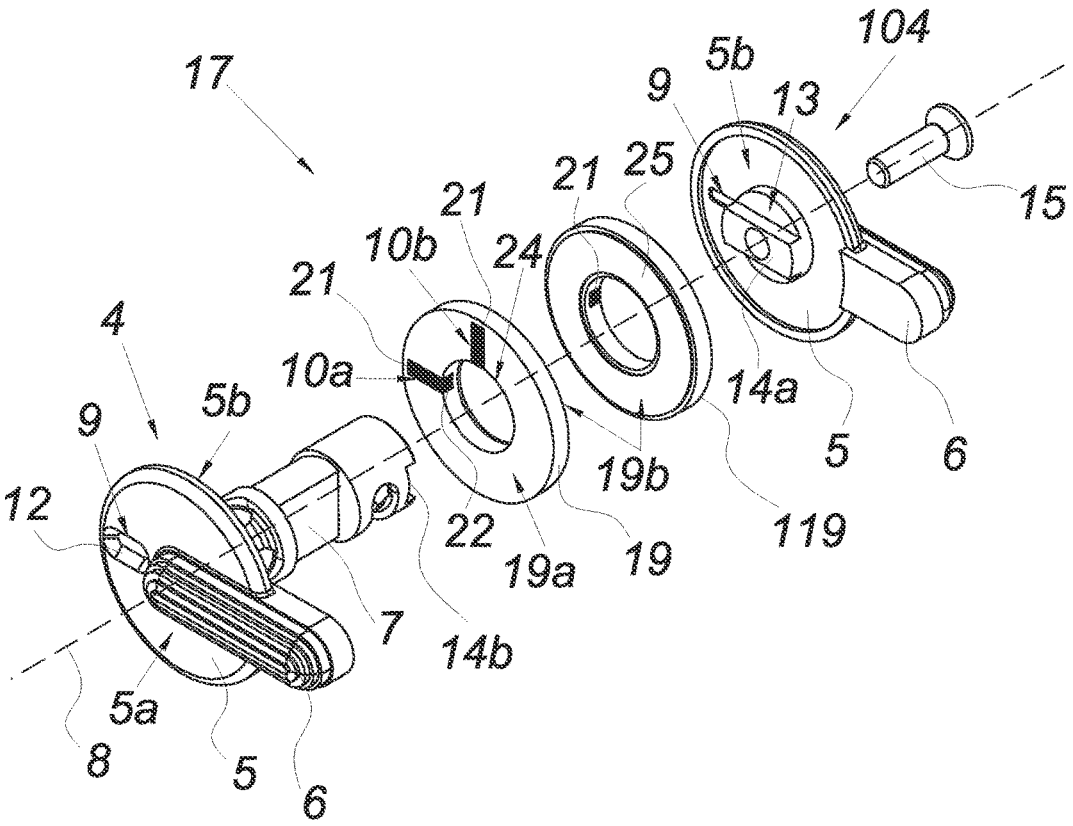
FIG. 2 shows an exploded view of the first embodiment of the safety selector assembly according to FIG. 1.

Each of these two safety selector levers 4, 104 has a head section 5 and a lever section 6. The lever section 6 is embodied as elongated and protrudes from the head section 5, as shown in the enlargement in FIG. 2. The lever section 6 is used to manually actuate the safety selector lever 4, 104 directly in order to thus rotate the head section 5 around a rotation axis 8 of a lever shaft 7 of the manual firearm safety 2—as indicated in FIG. 2. As a result, depending on the rotation position, the trigger path of the firearm 1, for example, can be either blocked or unblocked, etc.

The safety selector levers 4 and 104 differ essentially in terms of design in the region of the head section 5, which has a front side 5*a* and a back side 5*b*.

On its back side, the first safety selector lever 4 transitions into the lever shaft 7 in one piece, thus constituting this lever shaft 7. The lever shaft 7 protrudes perpendicularly from the back side 5*b* of the head section 5.

The back side 5*b* of the second safety selector lever 104, by contrast, has a connecting region 13 for connecting to a lever shaft 7. This design can permit a combination of a lever shaft 7 and a second safety selector lever 104 made of different materials. For example, a lever shaft 7 made of metal can be connected to a second safety selector lever 104 made of plastic in a simply designed way. However, the second safety selector lever 104 may also be made of metal.

Figure 7A:
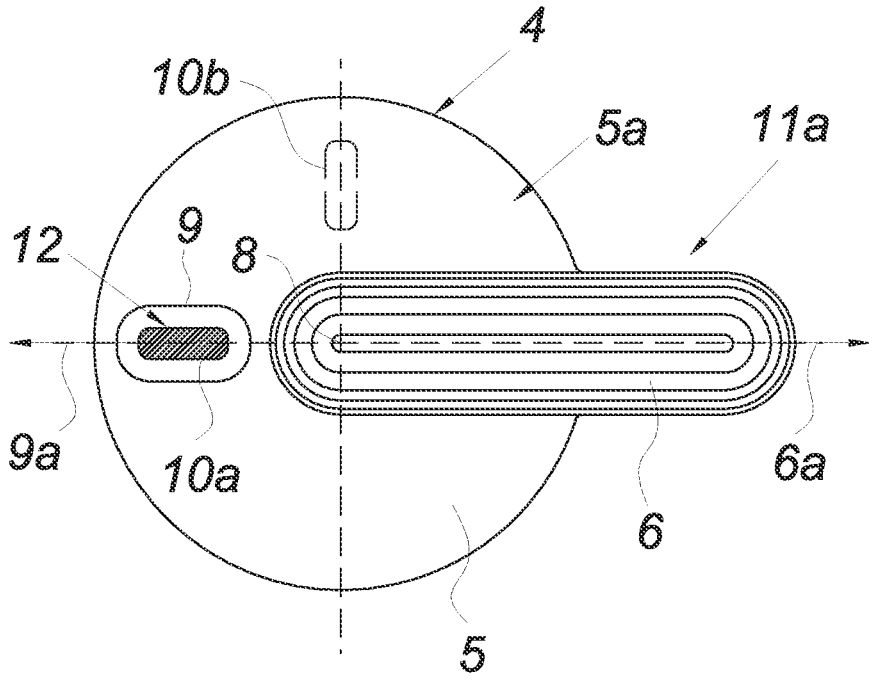
FIGS. 7*a* and 7*b* show side views of the safety selector lever in different rotation positions.
Figure 7B:
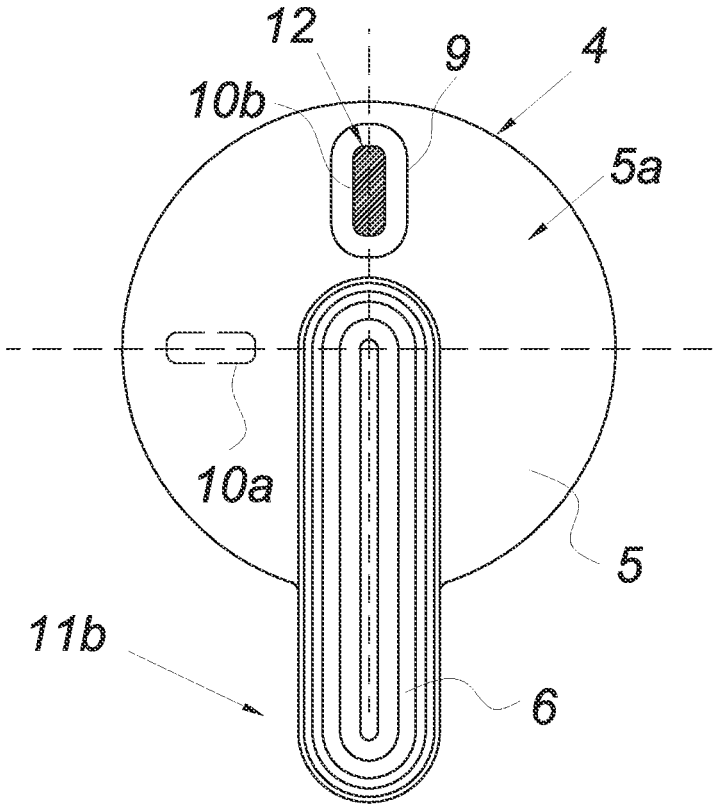

According to the invention, the head section 5 is embodied particularly so as to be able to indicate the mode of the firearm 1 to a weapon carrier in a clear and thus optically reliable way. The opacity and thus non-transparency of the head section 5 is therefore interrupted—specifically by means of a see-through region 9 between the front side 5*a* and back side 5*b* positioned eccentrically to the rotation axis 8. In the see-through region 9, it is therefore possible to see through the safety selector lever 4, 104, thus enabling visibility of at least one underlying safety marking 10*a*, 10*b* of the manual firearm safety 2—depending on the rotation position 11*a*, 11*b* of the safety selector lever 4, 104. Thus either a first safety marking 10*a* (for the safety mode of the firearm 1) is visible in a first rotation position 11*a* or a second safety marking 10*b* (for the ready-to-fire mode of the firearm 1) is visible in a second rotation position 11*b*—as a comparison of FIGS. 7*a* and 7*b* shows.

The firearm 1 can therefore be safely operated. It is thus also possible to unmistakably read the "safety mode" indicated by the first safety marking 10*a* or "ready-to-fire mode" indicated by the second safety marking 10*b*. Such "ready-to-fire mode" is, for example, a "semi-automatic fire mode," a "fully automatic fire mode," a "burst fire mode," or the like—which significantly simplifies the handling of the firearm 1 and also makes it much safer. This even more, if the dimensions of the see-through region 9 are such that only one safety marking 10*a*, 10*b* can be visually perceived through this see-through region 9. For example, the see-through area of see-through region 9 corresponds to the area of the safety marking 10*a*, 10*b*. Also, there is, for example, only one see-through region 9 in the head section 5. The first and second safety markings 10*a*, 10*b* are visually different, namely having different colors.

As can also be seen in FIGS. 1 to 7, the see-through region 9 is embodied by an opening 12 in the head section 5, which opening 12 penetrates the head section 5 from the front side 5*a* to the back side 5*b*. This opening 12 extends in a straight line and in the radial direction in the head section 5—as shown in detail in FIGS. 7*a* and 7*b*.

The lever section 6 extending in a straight line also protrudes from the head section 5 in the radial direction.

As is also shown in detail by FIG. 7*a*, the radial paths 6*a*, 9*a* of the lever section 6 and the see-through region 9 are positioned so that they are aligned with each other, thus achieving an intuitive ascertainment of the respective mode when manually actuating the safety selector lever 4.

The head section 5 is also embodied as circular in its outer dimensions. The lever section 6 extends partway across the head section 5—specifically on the front side 5*a*. Thus despite the compact dimensions of the safety selector lever 4, there can be a sufficiently large grip surface on the lever section 6 to permit a safer manual actuation.

The connecting region 13 with the lever shaft 7 is positioned centrally on the back side 5*b* of the head section 5 of the second safety selector lever 104—as shown in FIG. 2. In the connecting region 13, the head section forms a protruding tongue 14*a*, which can be inserted into a groove 14*b* embodied in complementary fashion on the lever shaft 7. A screw 15 secures the lever shaft 7 to the safety selector lever 4. This achieves a firm connection between the safety selector lever 4 and the lever shaft 7. This screw 15 protrudes through a central bore 16 in the head section 5 and is anchored in the lever shaft 7, as shown in FIG. 2.

The see-through region 9 is used for rapidly ascertaining the mode of the firearm 1. This mode of the firearm 1 is indicated in the form of a visually perceptible safety marking 10*a*, 10*b*.

So that the safety marking 10*a*, 10*b* can be retrofitted into a firearm 1 in a user-friendly way, the safety selector assemblies 17, 18, 28 for the retrofitting each have a support 19, 119, 20, 27. At least one safety marking 10*a*, 10*b* is provided on an outer surface 19*a*, 20*a*, 27*a* of the support 19, 119, 20, 27. This safety marking 10*a*, 10*b* is positioned in such a way that it is visible through the see-through region 9 of the head section 5 as a function of its rotational position relative to the support 19, 119, 20, 27.

To improve perceptibility, the safety markings 10*a*, 10*b* are embodied as radioluminescent, each having a radioluminescent light source. Gaseous tritium light sources 21 are used for this purpose, which are known as a GTLS in the prior art. In all of the exemplary embodiments, this gaseous tritium light source 21 has a hermetically sealed, round glass tube made of borosilicate glass as its outer envelope. The glass tube is coated on the inside with a luminophore such as zinc sulfide and filled with tritium. These gaseous tritium light sources 21 are each inserted into a respective slot-shaped recess 22 in the support 19, 119, 20, 27 and are hermetically sealed by a protective layer 23, which results in a flush finish with the support 19, 119, 20, 27. For the first and second safety markings 10*a*, 10*b* gaseous tritium light sources 21 with different visual colors are used.

The supports 19, 119, 20, 27 of each respective safety selector assembly 17, 18, 28 are embodied differently.

According to FIGS. 1 and 2, the first support 19, 119 of the first safety selector assembly 17 is embodied as annular. The lever shaft 7 protrudes through its central through-hole 24. An adhesive layer 25 is provided on an outer surface 19*b* opposite from the outer surface 19*a*. By means of this adhesive layer 25, the first support 19 is coupled to the housing 3 of the firearm 1 and secured against rotation. As a result, the position of the safety markings 10*a*, 10*b* of the first support 19, 119 is fixed relative to the housing 3 of the firearm 1. A support 19 or 119 is provided for each safety selector lever 4, 104; it is thus possible for the same functionality of the manual firearm safety 2 to be enabled on each side of the firearm 1, as has already been described for the safety selector lever 4. The supports 19, 119 may be made of plastic, for example.

Figure 3:
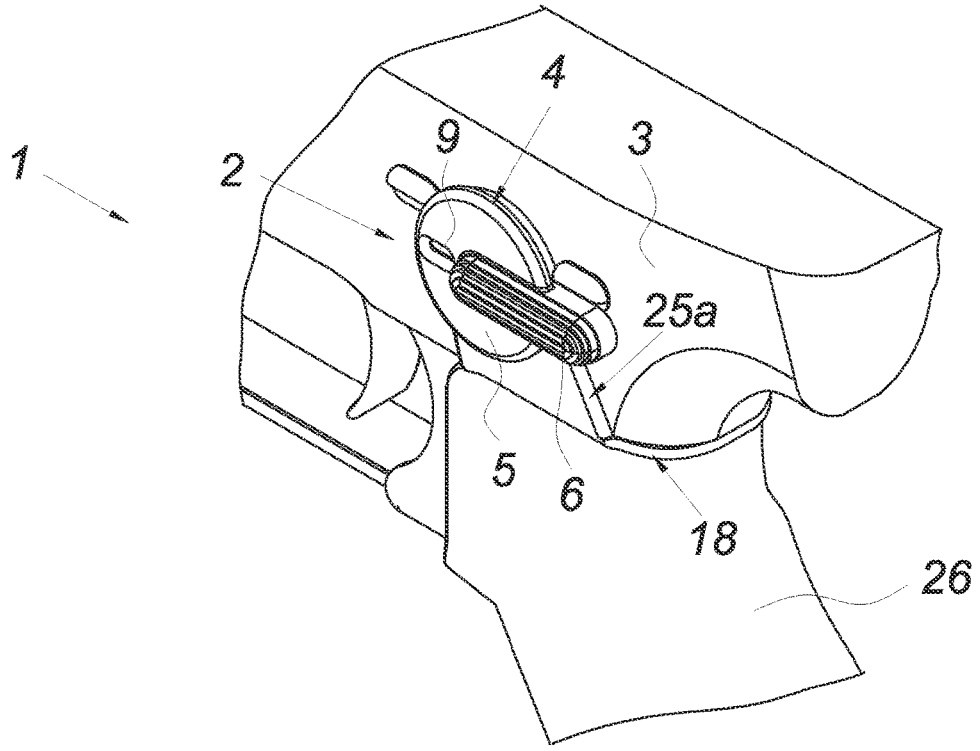
FIG. 3 shows a view of a partially depicted firearm with a second embodiment of the safety selector assembly for retrofitting a manual firearm safety of a firearm.
Figure 4:
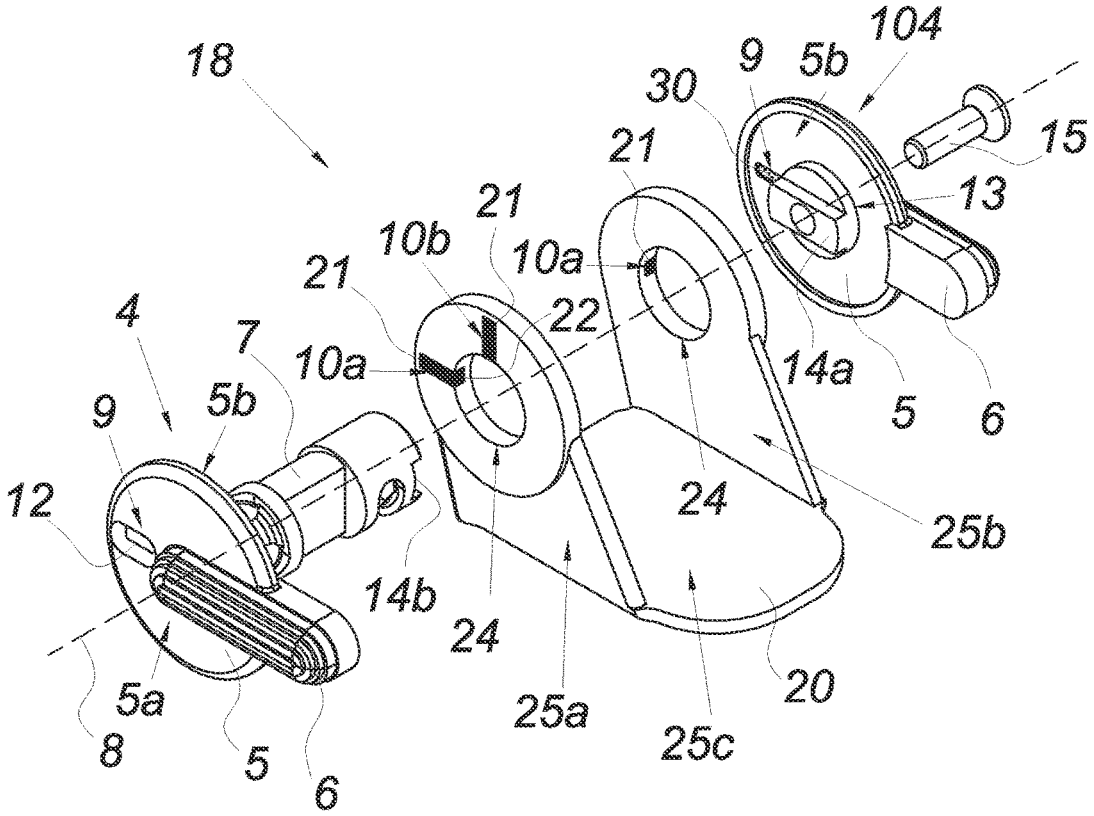
FIG. 4 shows an exploded view of the second embodiment of the safety selector assembly according to FIG. 3.

In the second safety selector assembly 18 shown in FIGS. 3 and 4, the second support 20 is embodied as U-shaped. For this purpose, the second support 20 has two identically embodied legs 25*a*, 25*b* and a connector piece 25*c* that connects these legs 25*a*, 25*b*. From this connector piece 25*c*, the two legs 25*a*, 25*b* protrude normally from the same side of the connector piece. At the same height in each leg 25*a*, 25*b*, a central through-hole 24 is provided through which the lever shaft 7 protrudes.

The second support 20 is formed in such a way that this second support 20 is inserted between the grip handle 26 and the housing 3 and can be clamped between these two parts of the firearm 1. The support 20 may be made of plastic, for example.

The support 20 protrudes with its two legs 25*a*, 25*b* over the housing 3 to the manual firearm safety 2 of the firearm 1. At least one leg 25*a* of the second support 20 has the two safety markings 10*a*, 10*b*. With a rotation of the head section 5, the see-through region 9 can be moved over the two respective safety markings 10*a* or 10*b*. This unblocks a view of one of the two safety markings 10*a* or 10*b*. The other safety marking 10*b* or 10*a* is hidden by the head section 5 due to its opacity and is therefore not optically perceptible.

Figure 5:
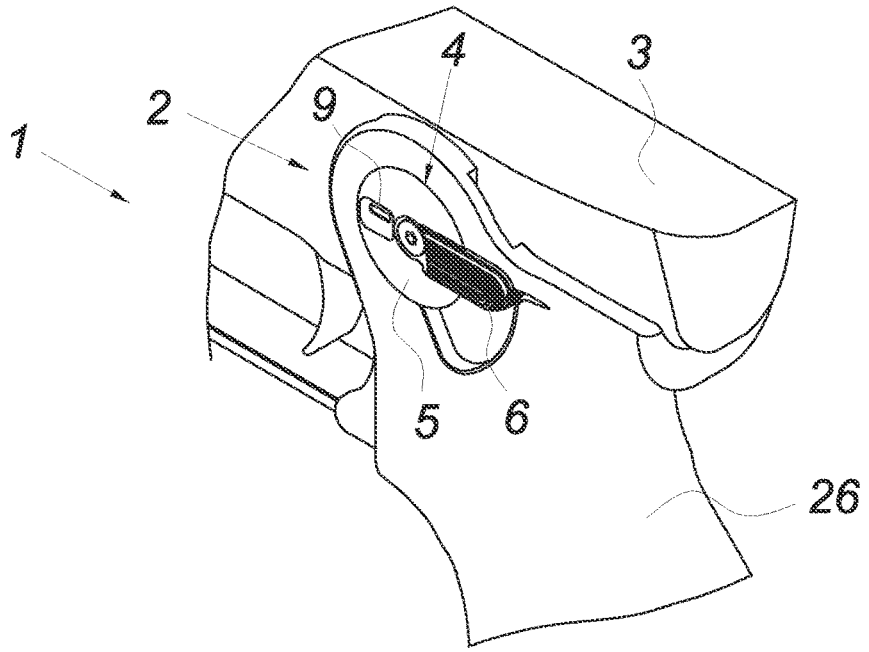
FIG. 5 shows a view of a partially depicted firearm with a third embodiment of the safety selector assembly for retrofitting a manual firearm safety of a firearm.
Figure 6:
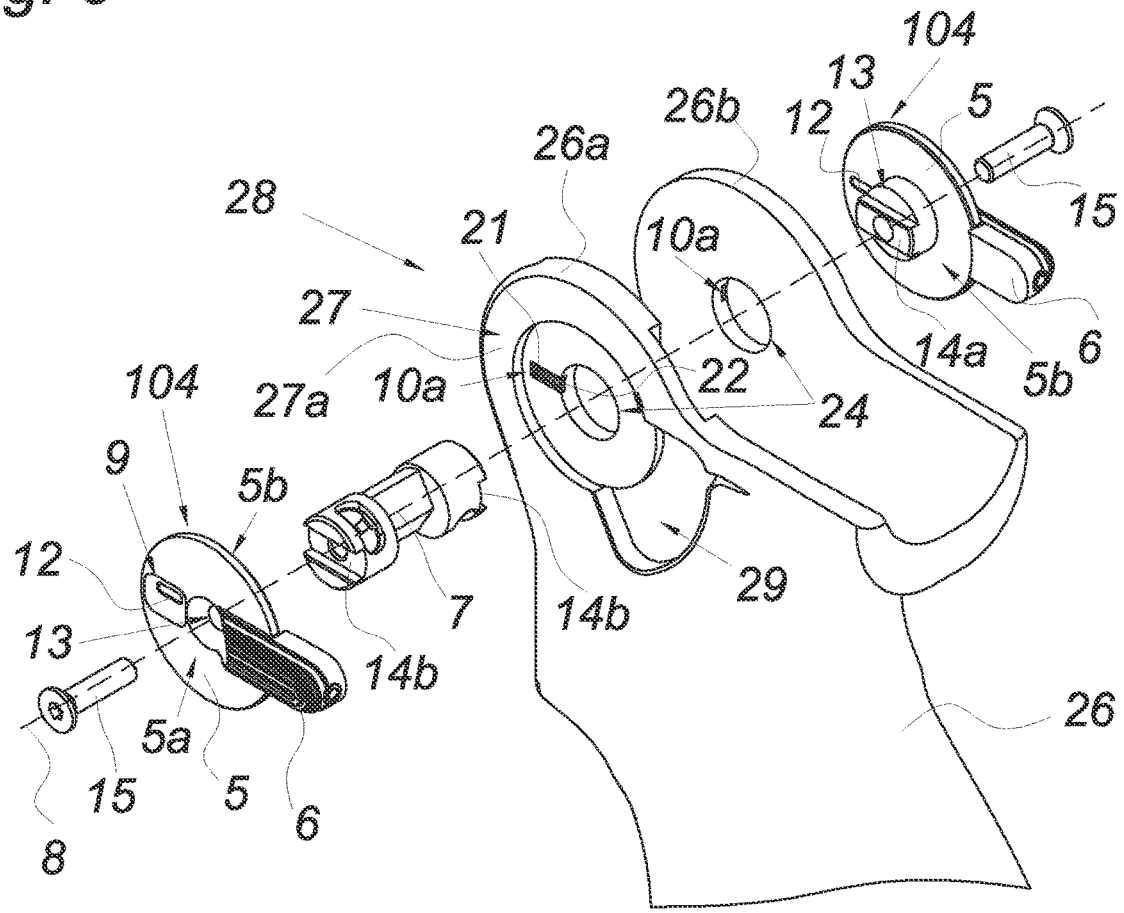
FIG. 6 shows an exploded view of the third embodiment of the safety selector assembly according to FIG. 5.

FIGS. 5 and 6 show the third support 27 of the third safety selector assembly 28. In this exemplary embodiment, two extension sections 26*a*, 26*b* of the grip piece 26 made of plastic form the support 27. These extension sections 26*a*, 26*b* protrude partway over the housing 3 of the firearm 1—specifically in the region of the manual firearm safety 2 on the housing 3. In the region of the manual firearm safety 2, the two extension sections 26*a*, 26*b* are embodied with a design similar to that of the legs 25*a*, 25*b* of the second safety selector assembly 18 and also each have a through-hole 24 at the same height for the lever shaft 7 to be guided through. A safety marking 10*a*, 10*b* is also provided in this region of each of the extension sections 26*a*, 26*b*.

By contrast with the second embodiment of the second safety selector assembly 18, the extension sections 26*a*, 26*b* of the third safety selector assembly 28 are each provided with a recess 29 in which the respective safety selector lever 4, 104 is rotatably supported. These recesses 29 also accommodate the respective safety marking 10*a* of each extension section 26*a*, 26*b*; only one safety marking 10*a* is visible in the first rotation position 11*a* in this exemplary embodiment according to FIGS. 5 and 6. In the second rotation position 11*b* no safety marking is visible. Alternatively, the second safety marking 10*b* in the other exemplary embodiments shown in FIGS. 1, 2, 3, 4, 7*a*, and 7*b* has been omitted here, but can also be provided and can be visible in the second rotation position 11*b*—which is not shown in FIGS. 5 and 6.

The third safety selector assembly 28 uses two second safety selector levers 104. This makes it possible, for example, to use a lever shaft 7 made of metal and second safety selector levers 104 made of plastic.

As is also indicated, for example, in the second safety selector lever 104 in FIG. 4, a transparent material 30 is provided in the see-through region 9 and penetrates the head section 5 from its front side to its back side 5*a*, 5*b*. This produces a window in the head section 5. The transparent material 30 is inserted into the opening 12. It is also conceivable, however, for the transparent material to be injected into an injection molding tool together with the opaque material in a 2-component injection molding process in order to thus produce the safety selector lever 104.

With this comparatively simple design of the safety selector assemblies 17, 18, 28, it is possible to retrofit the manual firearm safety 2 to enhance the reliability of its handling. This retrofitting does not require any modification to the firearm 1. This retrofitting is also easy to perform so that this retrofitting of the firearm 1 can be performed by the user independently.

The invention claimed is:

1. A safety selector lever for a manual firearm safety of a firearm, comprising:

a head section with a front side and a back side, wherein the head section has either a connecting region formed onto the back side for connecting to a lever shaft or a protruding lever shaft formed onto the back side, and an elongated lever section that adjoins the head section and is embodied for manual actuation of the safety selector lever in order to thus rotate the head section around a rotation axis of the lever shaft, wherein an opacity of the head section is interrupted by at least one see-through region between the front side and the back side, wherein the see-through region is formed by an opening in opaque material of the head section, and the opening penetrates the head section from the front side to the back side, or wherein the see-through region has a transparent material that penetrates the head section from the front side to the back side, with the at least one see-through region positioned eccentrically to the rotation axis in order to thus enable visibility of at least one safety marking of the manual firearm safety.

2. The safety selector lever according to claim 1, wherein the see-through region is formed by the opening in the opaque material of the head section, and the opening penetrates the head section from the front side to the back side.

3. The safety selector lever according to claim 1, wherein the see-through region has the transparent material that penetrates the head section from the front side to the back side.

4. The safety selector lever according to claim 1, wherein the see-through region in the head section extends in a radial direction and/or the see-through region in the head section extends in a straight line.

5. The safety selector lever according to claim 1, wherein the lever section extends in a straight line and protrudes from the head section in a radial direction.

6. The safety selector lever according to claim 1, wherein radial paths of the see-through region and the lever section are positioned so that the radial paths are aligned with each other.

7. The safety selector lever according to claim 1, wherein the head section is embodied as circular in its outer dimensions and/or the lever section extends partway across the head section.

8. The safety selector lever according to claim 1, wherein the connecting region or the lever shaft is provided centrally on the back side of the head section.

9. The safety selector lever according to claim 1, wherein the head section has the connecting region and the connecting region is embodied as a protruding tongue on the back side of the head section.

10. A safety selector assembly for a manual firearm safety of a firearm, comprising:

the safety selector lever according to claim 1; and a support having a first safety marking of the at least one safety marking, wherein the head section of the safety selector lever is rotatable relative to the support about the rotation axis, and the first safety marking is visible through the see-through region of the head section in a first rotational position of the head section and not visible through the see-through region of the head section in a second rotational position of the head section.

11. The safety selector assembly according to claim 10, wherein the support comprises a second safety marking that is visible through the see-through region of the head section in the second rotational position of the head section and not visible through the see-through region of the head section in the first rotational position of the head section.

12. The safety selector assembly according to claim 10, wherein the at least one safety marking comprises a light source, said light source is selected from the group consisting of: an electroluminescent light source, a phosphorescent light source, a fluorescent light source, a radioluminescent light source, a bioluminescent light source, and combinations thereof.

13. The safety selector assembly according to claim 12, wherein at least one gaseous tritium light source is provided as the radioluminescent light source.

14. The safety selector assembly according to claim 13, wherein the gaseous tritium light source is provided in at least one recess of the support and/or is hermetically sealed by a protective layer.

15. The safety selector assembly according to claim 10, wherein the support is annular and/or has an adhesive on a second outer surface of the support that is situated opposite from a first outer surface of the support on which the at least one safety marking is situated.

16. The safety selector assembly according to claim 10, wherein the support has at least one leg and a connector piece that connects to the at least one leg, wherein the at least one leg has the at least one safety marking.

17. The safety selector assembly according to claim 16, wherein the support is embodied as U-shaped with two legs and with the connector piece connecting the two legs.

18. The safety selector assembly according to claim 17, wherein at the same height, the two legs each have a through-hole for guiding the lever shaft through.

19. The safety selector assembly according to claim 10, wherein at least one extension section of a grip handle of the firearm forms the support, and the at least one extension section has the at least one safety marking.

20. The safety selector assembly according to claim 19, wherein the grip handle has two identical extension sections, each with the at least one safety marking and/or each of the extension sections has a through-hole for guiding the lever shaft through.

21. The safety selector assembly according to claim 19, wherein the at least one extension section has a recess in which the safety selector lever is rotatably supported.

22. A firearm with a manual firearm safety, which has a safety selector assembly according to claim 10.

23. A firearm with a manual firearm safety, which has a safety selector lever according to claim 1.

* * * * *